US010189273B2

(12) United States Patent
Hayashi et al.

(10) Patent No.: US 10,189,273 B2
(45) Date of Patent: Jan. 29, 2019

(54) HEAD UNIT HAVING NOZZLE CHIPS ARRANGED SIDE BY SIDE AND LIQUID JETTING APPARATUS INCLUDING THE SAME

(71) Applicant: BROTHER KOGYO KABUSHIKI KAISHA, Nagoya-shi, Aichi-ken (JP)

(72) Inventors: Hideki Hayashi, Nagoya (JP); Keita Sugiura, Toyoake (JP); Taisuke Mizuno, Yokkaichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/464,882

(22) Filed: Mar. 21, 2017

(65) Prior Publication Data

US 2017/0282553 A1 Oct. 5, 2017

(30) Foreign Application Priority Data

Mar. 31, 2016 (JP) ..... 2016-070943

(51) Int. Cl.
*B41J 2/21* (2006.01)
*B41J 2/145* (2006.01)

(52) U.S. Cl.
CPC ..... *B41J 2/2146* (2013.01); *B41J 2/145* (2013.01); *B41J 2202/19* (2013.01); *B41J 2202/20* (2013.01)

(58) Field of Classification Search
CPC ..... B41J 2/2146; B41J 2/145; B41J 2202/19; B41J 2202/20; B41J 2/155
See application file for complete search history.

(56) References Cited

U.S. PATENT DOCUMENTS

2015/0158296 A1* 6/2015 Togashi ..... B41J 2/1433 347/44
2015/0174901 A1* 6/2015 Akahane ..... B41J 2/14233 347/44

FOREIGN PATENT DOCUMENTS

CN 104691109 A 6/2015
JP 2015-110305 A 6/2015
JP 2015-120292 A 7/2015

OTHER PUBLICATIONS

Chinese Official Action dated Aug. 1, 2018 received in related application CN 201710164766.7, together with an English language translation.

* cited by examiner

*Primary Examiner* — Henok Legesse
(74) *Attorney, Agent, or Firm* — Scully, Scott, Murphy & Presser, P.C.

(57) ABSTRACT

A head unit includes: nozzle chips which are arranged side by side in a first direction, each of the nozzle chips having a jetting surface and nozzles aligned in a predetermined direction parallel to the jetting surface and crossing both of the first direction and a second direction orthogonal to the first direction; a holder configured to hold the nozzle chips from a side opposite to the jetting surface; and a fixing plate to which the nozzle chips are fixed and which is arranged on a side facing the jetting surface of each of the nozzle chips, wherein the holder has first walls arranged in the second direction so as to sandwich the nozzle chips therebetween; each of the first walls has first projections formed on an end surface thereof facing the fixing plate; and the first projections make contact with the fixing plate.

21 Claims, 18 Drawing Sheets

HEAD UNIT HAVING NOZZLE CHIPS ARRANGED SIDE BY SIDE AND LIQUID JETTING APPARATUS INCLUDING THE SAME

CROSS REFERENCE TO RELATED APPLICATION

The present application claims priority from Japanese Patent Application No. 2016-070943 filed on Mar. 31, 2016 the disclosure of which is incorporated herein by reference in its entirety.

BACKGROUND

Field of the Invention

The present invention relates to a head unit, and a liquid jetting apparatus provided with a plurality of head units.

Description of the Related Art

Conventionally, there is known a line-type jetting head, as the liquid jetting apparatus, having a configuration wherein a plurality of head units (ink-jet recording heads) are arranged side by side in the width direction of a recording medium.

In such a line-type jetting head, each of the head units has a plurality of nozzle chips (head bodies) which are arranged side by side in the width direction of the recording medium, a holding member holding the plurality of nozzle chips, and a fixing plate arranged on a side of jetting surfaces of the plurality of nozzle chips.

A plurality of nozzles of each of the nozzle chips are aligned in an oblique direction crossing each of the width direction of the recording medium and a conveyance direction in which the recording medium is conveyed. The upper surfaces of the plurality of nozzle chips are joined to the back surface of the holding member with an adhesive. In this line-type jetting head, the variation (unevenness) in heights of the jetting surfaces among the plurality of nozzle chips is absorbed by the adhesive between the nozzle chips and the holding member.

On the other hand, there is also known a line-type jetting head having such a configuration that the positions of a plurality of head units are alternately shifted in the conveyance direction of the recording medium (a so-called staggered arrangement), and which also has a common fixing plate arranged on a side facing the jetting surfaces of the plurality of head units, and a case member arranged on a side opposite to the fixing plate with respect to the plurality of head units.

The case member has walls arranged to surround the head units, respectively, and a plurality of projections (projecting portions) are formed on each of the walls at an end surface thereof on the side facing the fixing plate. By pressing the plurality of projections against the fixing plate, the fixing plate is made to follow the positions of end portions of the plurality of projections. With this, the flatness of the fixing plate is enhanced, thereby suppressing any variation in the heights of the jetting surfaces among the plurality of head units.

SUMMARY

In the former line-type jetting head, any variation in the heights of the jetting surfaces among the plurality of nozzle chips is absorbed by the adhesive. In reality, however, it is difficult to suppress the above-described variation to be small only with the adhesive.

On the other hand, in the latter line-type jetting head, an attempt is made to flatten the fixing plate by pressing, against the fixing plate, the plurality of projections which are formed in the case member and arranged so as to surround the respective head units. However, in a case that an attempt is made to apply the technique of the latter line-type jetting head to the configuration of the former line-type jetting head, the following problem might occur.

In the former line-type jetting head, the nozzles are aligned in rows in the oblique direction crossing both of the conveyance direction and the width direction of the recording medium. In this configuration, it is desired that the distance between the nozzle chips which belong respectively to two head units, included in the plurality of head units, and which are adjacent in the width direction is decreased as little as possible, from the viewpoint of arranging nozzles belonging to the two adjacent head units respectively at an equal spacing distance with respect to the width direction, or from the viewpoint of partially overlapping the positions in the width direction of the nozzles belonging to one of the two adjacent head units respectively with the positions in the width direction of the nozzles belonging to the other of the two adjacent head units.

However, as in the configuration of the latter line-type jetting head wherein each of the walls is present to surround one of the head units, the walls are arranged with respect to one of the head units, at both outsides in the width direction of the recording medium. Accordingly, in a case that the configuration of the latter line-type jetting head is applied as it is to the former line-type jetting head, the walls are consequently arranged between the adjacent two head units. Accordingly, this increases the distance between the nozzle chips which belong to the two adjacent head units, respectively, and which are adjacent to each other.

The present teaching has been made in view of the above-described situation, and object of the present teaching is to suppress any variation in heights in the jetting surfaces of the plurality of nozzle chips in an assured manner, without increasing the distance between the nozzle chips which belong to the adjacent head units, respectively, and which are adjacent to each other.

According to a first aspect of the present teaching, there is provided a head unit including:

nozzle chips which are arranged side by side in a first direction, each of the nozzle chips having a jetting surface and nozzles aligned in a predetermined direction parallel to the jetting surface and crossing both of the first direction and a second direction orthogonal to the first direction;

a holder configured to hold the nozzle chips from a side opposite to the jetting surface of each of the nozzle chips; and a fixing plate to which the nozzle chips are fixed and which is arranged on a side facing the jetting surface of each of the nozzle chips, wherein the holder has first walls arranged in the second direction so as to sandwich the nozzle chips therebetween, each of the first walls has first projections formed on an end surface thereof facing the fixing plate, and the first projections make contact with the fixing plate.

In the head unit according to the first aspect of the present teaching, two nozzle chips included in the nozzle chips may be exposed from the holder in the first direction.

According to a second aspect of the present teaching, there is provided a liquid jetting apparatus including head units arranged side by side in a first direction, each of the head units including:

nozzle chips which are arranged side by side in the first direction, each of the nozzle chips having a jetting surface and nozzles aligned in a predetermined direction parallel to the jetting surface and crossing both of the first direction and a second direction orthogonal to the first direction;

a holder configured to hold the nozzle chips from a side opposite to the jetting surface of each of the nozzle chips; and a fixing plate to which the nozzle chips are fixed and which is arranged on a side facing the jetting surface of each of the nozzle chips, wherein the holder has first walls arranged in the second direction so as to sandwich the nozzle chips therebetween;

two nozzle chips included in the nozzle chips are exposed from the holder in the first direction;

each of the first walls has first projections formed on an end surface thereof facing the fixing plate; and the first projections make contact with the fixing plate.

DESCRIPTION OF THE EMBODIMENTS

Next, an embodiment of the present teaching will be explained, with reference to the drawings as appropriate. Note that in the following explanation, a conveyance direction in which a recording paper (recording sheet) 100 is conveyed is defined as the front/rear direction of a printer 1. Further, the width direction of the recording paper 100 (paper-width direction or sheet-width direction) is defined as the left/right direction of the printer 1. Furthermore, a direction perpendicular to the sheet surface of FIG. 1 and orthogonal to the front/rear direction and the left/right direction is defined as the up/down direction of the printer 1.

<Schematic Configuration of Printer>

Figure 1:
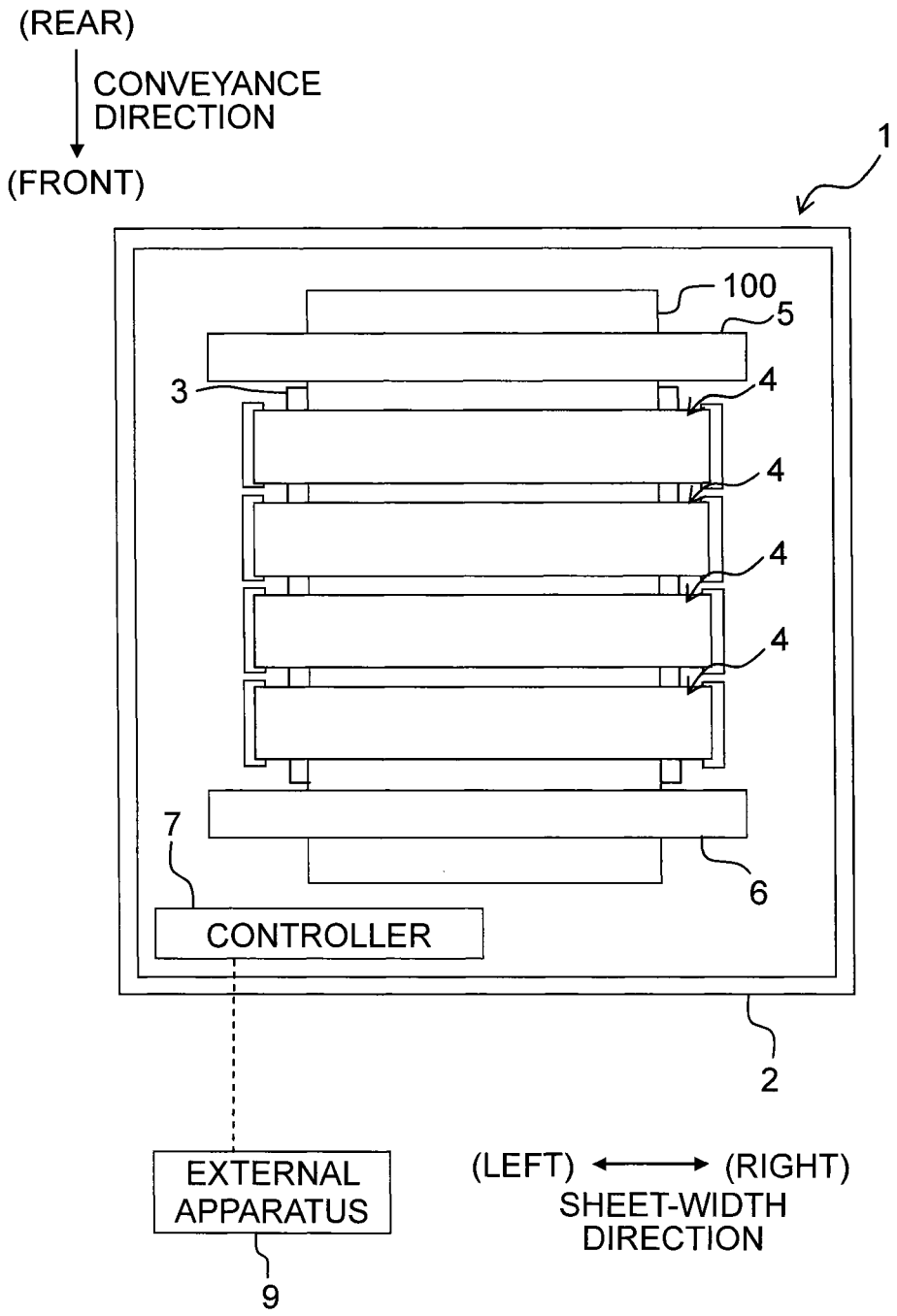
FIG. 1 is a schematic plane view of a printer according to an embodiment of the present teaching.

As depicted in FIG. 1, the printer 1 is provided with a casing 2, a platen 3 accommodated in the inside of the casing 2, four ink-jet head 4, two conveyance rollers 5 and 6, a controller 7, etc.

The recording paper 100 is place on the upper surface of the platen 3. The four ink-jet heads 4 are arranged side by side in the conveyance direction at a location above the platen 3. Each of the ink-jet heads 4 is a so-called line type head having a plurality of nozzles 15 (see FIG. 2) which are arranged side by side in the width direction of the recording paper. In each of the ink-jet heads 4, ink is supplied from a non-illustrated ink tank. Note that inks of four different colors are supplied to the four ink jet heads, respectively. Namely, the four ink jet heads 4 jet the mutually different color inks, respectively.

As depicted in FIG. 1, the two conveyance rollers 5 and 6 are arranged respectively on the rear and front sides with respect to the platen 3. The two conveyance rollers 5 and 6 are driven by non-illustrated motors, respectively, and convey the recording paper 100 on the platen 3 in the front direction.

The controller 7 is provided with a CPU (Central Processing Unit), a ROM (Read Only Memory), a RAM (Random Access Memory) and ASIC (Application Specific Integrated Circuit) including a various kinds of control circuits. Further, the controller 7 is connected data-communicatively to an external apparatus 9 such as a PC, and is configured to control various parts or elements of the printer 1 based on a print data transmitted from the external apparatus 9.

More specifically, the controller 7 controls the motors driving the two conveyance rollers 5 and 6 so as to allow the two conveyance rollers 5 and 6 to convey the recording paper 100 in the conveyance direction. Further, while doing so, the controller 7 controls the four ink-jet heads 4 to cause the ink jet heads 4 to jet the inks towards the recording paper 100. By doing so, an image, etc., is printed on the recording paper 100.

<Detailed Configuration of Ink-Jet Head>

Figure 2:
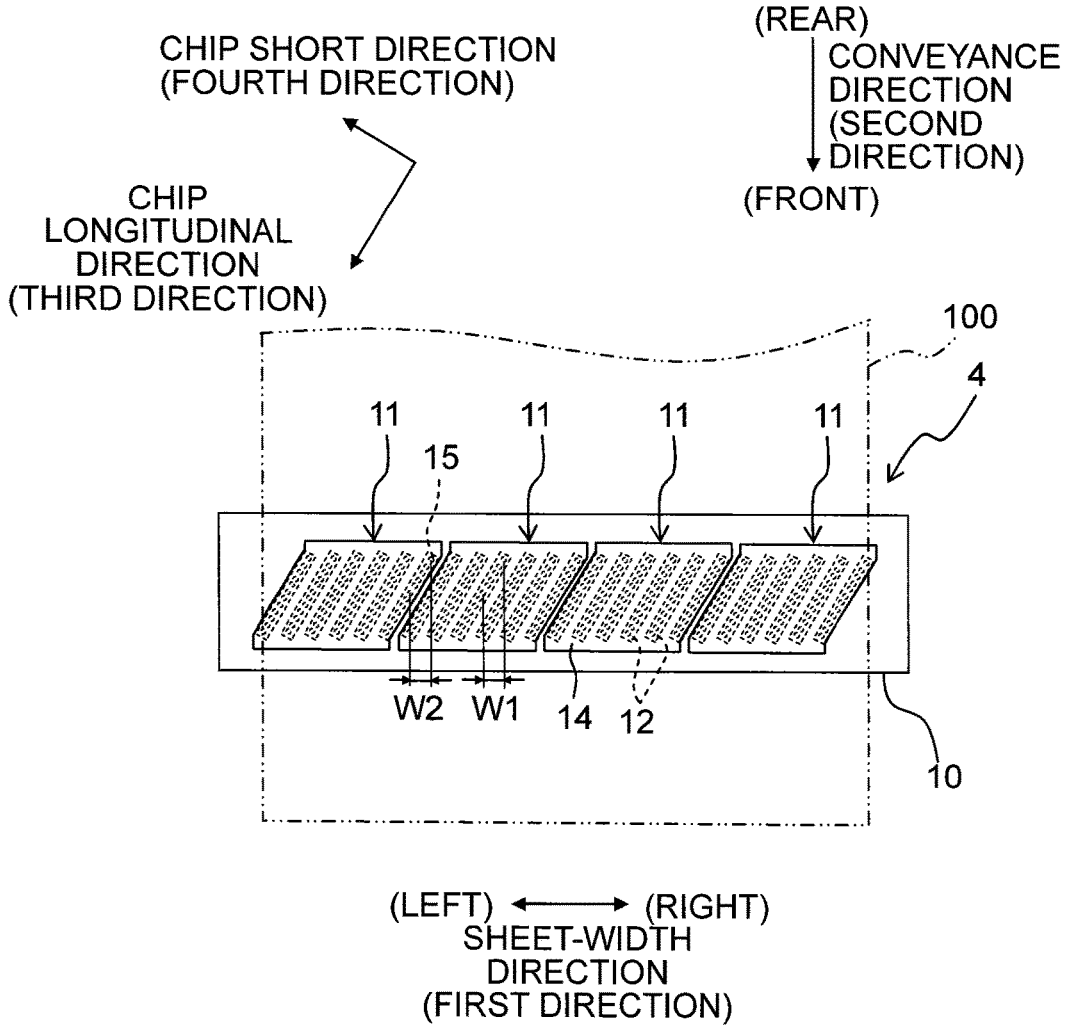
FIG. 2 is a plane view of an ink-jet head.

Next, the ink jet heads 4 will be explained in detail. As depicted in FIG. 2, each of the ink-jets 4 is provided with four head units 11 which are attached to a unit holding plate 10 in a state that the four head units 11 are arranged side by side in the left/right direction. Each of the four head units 11 is connected to a common ink tank (not depicted in the drawings) via an ink supply hole 23 (see FIG. 3) which is formed in a holder 14 (to be described later on). Namely, the respective four head units 11 jet a same color ink.

Figure 3:
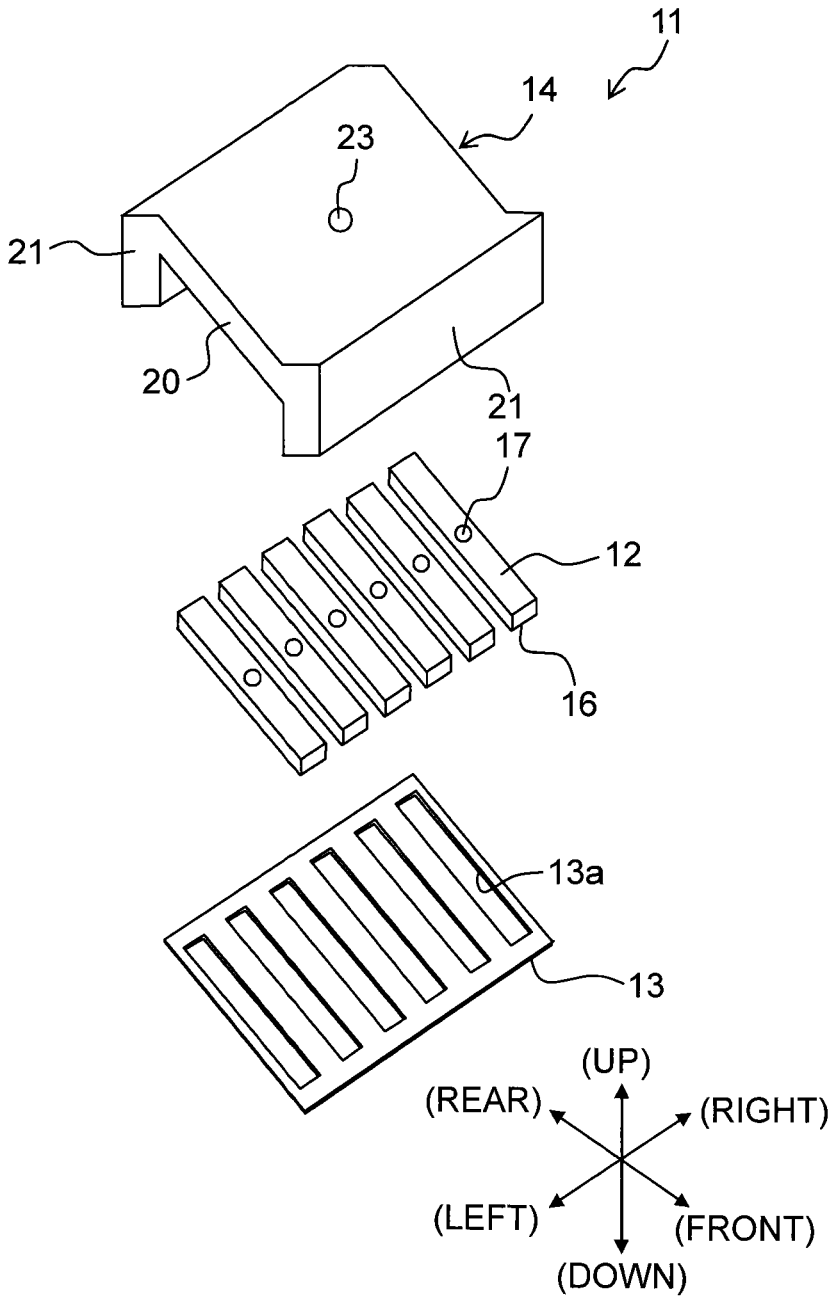
FIG. 3 is an exploded perspective view of a head unit.
Figure 4:
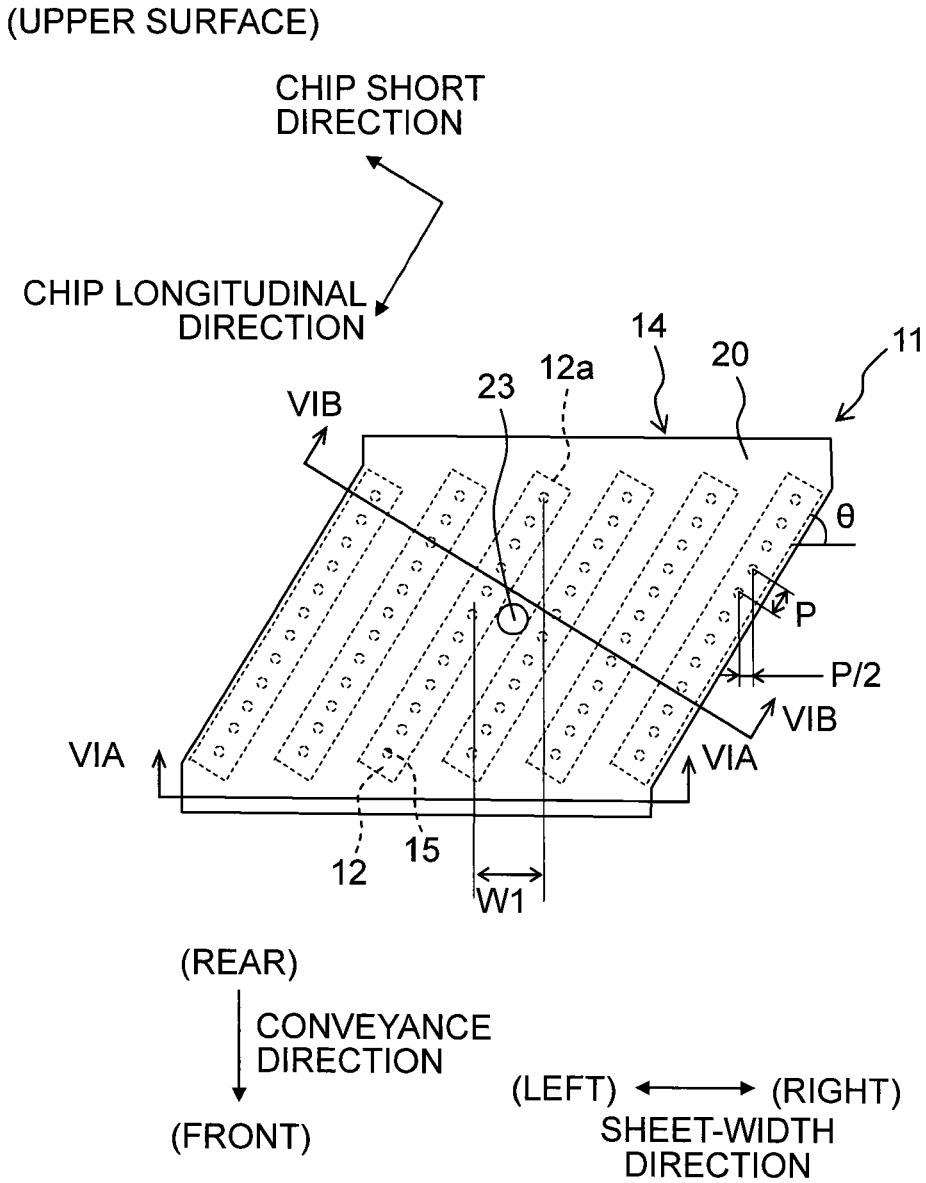
FIG. 4 is a top view of the head unit.
Figure 5:
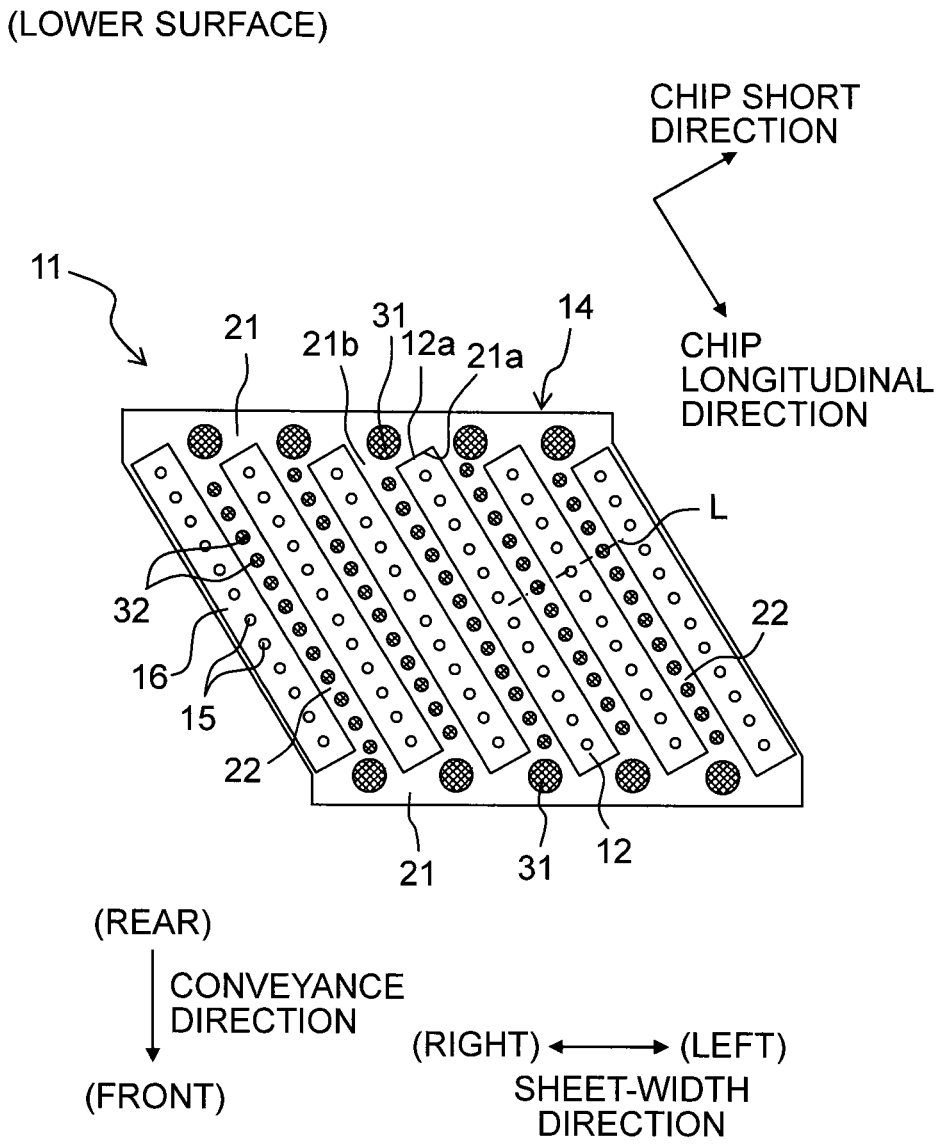
FIG. 5 is a bottom view of the head unit in a state that a fixing plate is removed.

As depicted in FIGS. 3 to 5, each of the head units 11 is provided with six nozzle chips 12, a fixing plate 13, and a holder 14. Each of the nozzle chips 12 has a planar shape that is rectangular, and the plurality of nozzles 15 are aligned (in a row) on the lower surface of each of the nozzle chip 12, along the longitudinal direction thereof. Namely, the lower surface of each of the nozzle chips 12 is a jetting surface 16 in which the ink is jetted from the plurality of nozzles 15.

Here, provided that the ink-jet head 4 were a general line head, each of the nozzle chips 12 is arranged such that the longitudinal direction thereof is parallel to the width direction of the recording paper. In contrast, in the embodiment, each of the nozzle chips 12 is arranged such that the longitudinal direction thereof crosses (intersects) the left/right direction as the width direction of the recording paper and crosses the front/rear direction as the conveyance direction, namely to assume an oblique posture. The six nozzle chips 12 each of which is arranged in the oblique posture are arranged side by side in the left/right direction. Among two nozzle chips 12, among the six nozzle chips 12, which are adjacent in the left/right direction in each of the head units 11, a part or portion of the nozzles 15 are overlapped in the conveyance direction. As depicted in FIG. 3, a central portion in the longitudinal direction of each of the nozzle chips 12 is formed with a supply port 17 communicating with an ink supply hole of the holder 14 (to be described later on).

An inclination angle θ of each of the nozzle chips 12 with respect to the left/right direction is not particularly limited. However, as the angle θ is made greater, the arrangement spacing distance between the nozzles 15 in the left/right direction becomes smaller, thereby making it possible to increase the resolution of the head 4. As depicted in FIG. 4, a case is assumed wherein the arrangement pitch (alignment pitch) of the nozzles 15 in the longitudinal direction of chip (chip longitudinal direction) of each of the nozzle chips 15 is made to be "P"; under a condition that the angle θ is, for example, 60 degrees, the arrangement pitch (alignment pitch) of the nozzles 15 in the width direction of the recording paper becomes "P/2". Conversely, as the angle θ is made smaller, although the arrangement spacing distance between the nozzles 15 in the left/right direction becomes greater (thereby reducing the resolution of the head 4), this makes it possible to increase the width (overlapping width W1) of a portion at which nozzles 15 overlap with each other between adjacent nozzle chips 12 in the conveyance direction. Note that in a case that the above-described overlapping width W1 is small, the unevenness (irregularity) in density of an image formed by nozzles 15 which are overlapped in the conveyance direction tends to be conspicuous. Due to this, the overlapping width W1 is preferably large in view of improving the image quality.

Note that each of the nozzle chips 12 has a rectangular planar shape, and an end surface 12*a* of an end portion, of each of the nozzle chips 12, in the chip longitudinal direction of the nozzle chip 12 is parallel to a direction (short direction of the chip; chip short direction) which is orthogonal to the chip longitudinal direction. The nozzle chip 12 having the above-described rectangular shape is easily usable for an ink jet head of another system, and has a high versatility. For example, by arranging the nozzle chips 12 of the embodiment such that the chip longitudinal direction is parallel to the conveyance direction of the recording paper, it is possible to construct an ink jet head of the so-called serial type which jets an ink while the ink-jet head is allowed to move in the width direction of the recording paper. In this situation, in a case that the planar shape of each of the nozzle chips 12 is rectangular, namely, is such a shape that the end surface 12*a* of the chip longitudinal direction is parallel to the chip short direction, it is possible to make the size in the conveyance direction of the ink jet head of the serial type to be small.

As depicted in FIG. 2, also between two nozzle chips 12 belonging to two adjacent head units 11, respectively, a part of the nozzles 15 are overlapped with each other in the conveyance direction. By arranging the nozzles 15 each constructing one of the four head units 11 to be joined (linked) with each other in the width direction of the recording paper, a head of the line type is realized. Note that in the present embodiment, the overlapping width W1 of the nozzles 15 between two nozzle chips 12 in each of the head units 11 (hereinafter referred to as "one head unit 11, as appropriate), and an overlapping width W2 of the nozzles 15 between two nozzle chips 12 belonging to adjacent two head units 11, respectively, are made to be same. For example, provided that the overlapping width W1=W2=4.2225 mm. Further, provided that the inclination angle θ of the nozzle chip 12 is 60 degrees; and that the arrangement pitch (alignment pitch) P of the nozzles 15 in the chip longitudinal direction is 84.7 μm (300 dpi), then the arrangement pitch (alignment pitch) P of the nozzles 15 in the paper width direction becomes P/2=42.35 μm. In this case, since the number of nozzles 15 included in the overlapping width W1 (W2) is W1/(P/2), namely, is approximately 100 pieces. Consequently, about ¼ of all the nozzles 15 of each of the nozzle chips 12 overlap with one another.

The fixing plate 13 is a plate member formed of a metal, etc. The fixing plate 13 is arranged at a location below the six nozzle chips 12, namely, arranged on the side facing the jetting surfaces 16 of the nozzle chips 12. The fixing plate 13 is formed with six holes 13*a* each of which is configured to expose the jetting surface 16*a* of one of the six nozzle chips 12. As depicted in FIG. 6B, each of the nozzle chips 12 is joined, with an adhesive 18, to a surrounding area of one of the holes 13*a* corresponding thereto and formed in the upper surface of the fixing plate 13. Note that the six holes 13*a* are formed by the punching processing. During the punching processing, since the edge portion of each of the holes 13*a* is deformed to a small extent, the flatness (planeness) of the lower surface of the fixing plate 13 becomes great. Note that the term "flatness" is an index indicating the extent of deviation from an ideal flat surface, and as the flatness of a surface as the object is smaller, the object surface approaches closely to the ideal flat surface. The increase in (degradation of) the flatness due to the punching processing is corrected by projections 31 and 32 formed in the holder 14, as will be described next.

The holder 14 is produced, for example, by injection molding using a synthetic resin material. The holder 14 is arranged to cover the six nozzle chips 12 from thereabove, and holds the six nozzle chips 12. As depicted in FIGS. 3 to 5, the holder 14 has a ceiling portion 20, two first walls 21 extending downward from the ceiling portion 20, and five second walls 22 similarly extending downward from the ceiling portion 20.

The ceiling portion 20 is arranged so as to overlap with the six nozzle chips 12 in the up/down direction. The ceiling portion 20 is formed with one ink supply hole 23. As depicted in FIG. 6B, the inner surface of the ceiling 20 is joined to the upper surfaces of the nozzle chips 12, with an adhesive 24. Although omitted in the drawings, an ink flow channel connected to the ink supply hole 23 is formed in the inside of the ceiling portion 20. The ink flow channel 23 is communicated with supply ports 17 of the six nozzle chips 12. The ink supplied from the non-illustrated ink tank to the ink supply hole 23 of each of the head units 11 is distributed to the supply holes 17 of the six nozzle chips 12 by the ink flow channel formed inside the ceiling portion 20. Namely, the nozzles 15 of the six nozzle chips 12 jet a same kind of ink.

The two first walls 21 extend downward respectively from both end portions in the front/rear direction of the ceiling portion 20, and cover the end surfaces 12*a* in the chip longitudinal direction of the six nozzle chips 12 from the front/rear direction. Note that as depicted in FIGS. 3 and 6B, any wall is not provided on both end portions in the left/right direction of the ceiling portion 20, thus allowing nozzle chips 12, included in the six nozzle chips 12, which are located at the both ends in the left/right direction to be exposed from the holder 14 in the left/right direction. Namely, both the left and right end portions of the holder 14 are open (released).

As described above, the direction of the end surface 12*a* of the end portion in the longitudinal direction of each of the nozzle chips 12 is orthogonal to the chip longitudinal direction. Namely, the end surface 12*a* is a surface crossing both of the front/rear direction and the left/right direction. On the other hand, each of portions on the inner sides in the front/rear direction of the first walls 21 is formed with six recesses 21*a* each having an inclined surface corresponding to the end surface 12*a* of one of the six nozzle chips 12, and the end portions of the nozzle chips 12 are inserted into the recesses 21*a*, respectively. Namely, the first walls 21 are arranged both on the front and rear sides, respectively, of the six nozzle chips 12 so as to sandwich the six nozzle chips 12 therebetween in the front/rear direction. Rear-side portions 21*b* (rear interposed portions 21*b*), of one of the two first walls 21 which is arranged on the front side of the six nozzle chips 12, are arranged to be interposed into a location between front end portions of adjacent nozzle chips 12 among the six nozzle chips 12. Similarly, front-side portions 21*b* (front interposed portions 21*b*), of the other of the two first walls 21 which is arranged on the rear side of the six nozzle chips 12, are arranged to be interposed into locations between rear end portions of adjacent nozzle chips 12 among the six nozzle chips 12.

Figure 6A:
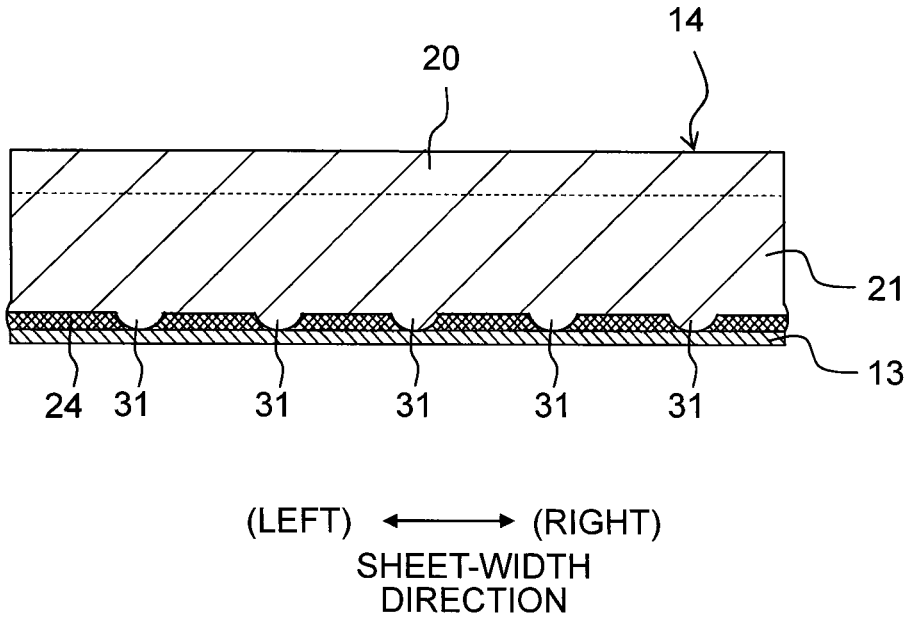
FIG. 6A is a cross-sectional view taken along a line VIA-VIA in FIG. 4.
Figure 6B:
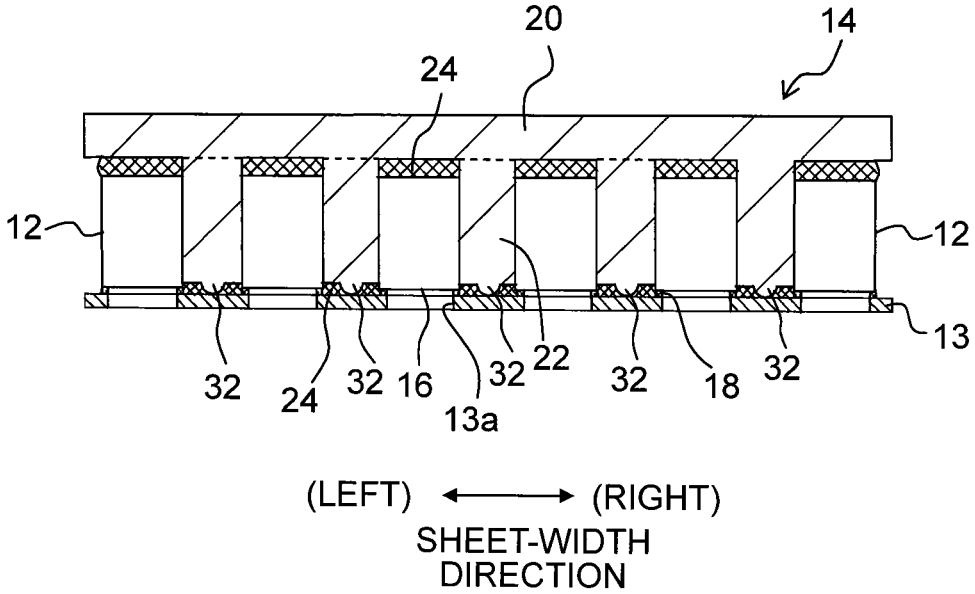
FIG. 6B is a cross-sectional view taken along a line VIB-VIB in FIG. 4.

As depicted in FIG. 5 and FIG. 6A, the lower surface of each of the first walls 21 has five first projections 31 which are formed in the lower surface with a spacing distance therebetween in the left/right direction. Each of the first projections 31 has, for example, a hemispherical outer shape and is formed integrally with the first wall 21 by the molding. Further, each of the first projections 31 has a portion thereof which is arranged in the interposed portion 21*a*, of each of the first walls 21, arranged to be interposed into the location between the end portions of the two nozzle chips 12. As depicted in FIG. 6A, the lower surface of each of the first walls 21 is joined to the fixing plate 13 with the adhesive 24 in a state that the five first projections 31 are pressed against and make contact with the upper surface of the fixing plate 13.

Each of the second walls 22 is arranged between two nozzle chips 12, among the six nozzle chips 12, which are adjacent in the left/right direction, and extends along the nozzle chips 12 in the longitudinal direction of the nozzle chips 12. The lower surface of each of the second walls 22 has a plurality of second projections 32 which are formed in the lower surface with a spacing distance therebetween in the chip longitudinal direction. Similarly to the first projections 31 as described above, each of these second projections 32 also has a hemispherical outer shape and is formed integrally with the second wall 22 by the molding. Note that, however, the size (dimension) of the first projection 31 is greater than the size of the second projection 32, as depicted in FIG. 5 and FIGS. 6A and 6B. Specifically, the diameter of the first projections 31 is 0.6 mm, and the diameter of the second projections 32 is 0.3 mm.

Further, the shapes of the first and second projections 31 and 32 are not limited to the above-described hemispherical shape. In view of joining (adhesion) to the fixing plate 13, the first and second projections 31 and 32 preferably have a shape having a flat surface on an end portion thereof, such as a columnar shape, a truncated conical shape, etc.

Furthermore, there are five gaps in total that are present among the six nozzle chips 12. The second walls 22 are arranged in all the five gaps, and the second projections 32 are formed in all of the five second walls 22. In this configuration, regarding four nozzle chips 12 which are included in the six nozzle chips 12 and which are located on the central side in the left/right direction, two pieces of the second walls 22 are consequently arranged on both sides in the left/right direction with respect to each of the four nozzle chips 12 on the central side. In addition, in this configuration, the second projections 32 of a second wall 22 located on one side with respect to a certain nozzle chips 12, among the four nozzle chips 12 on the central side, and the second projections 32 of another second wall 22 located on the other side with respect to the certain nozzle chip 12 are arranged to face one another in the chip short direction, with the certain nozzle chip 12 sandwiched therebetween. Namely, one of the second projection 32 located on one side with respect to the certain nozzle chip 12 and another one of the second projection 32 located on the other side with respect to the certain nozzle chip 12 are arranged on a same line L (see FIG. 5) that is parallel to the chip short direction.

As described above, the first projections 31 and the second projections 32 are formed at a time during the molding of the holder 14. Here, in the injection molding of the holder 14, it is difficult to uniformize the height position highly precisely over the entire area of the lower surface of the holder 14, due to any factor such as any expansion and contraction (shrinkage) of the resin material. In contract, the configuration provided with the plurality of first projection 31 and the plurality of second projections 32 in the lower surface of the holder 14, it is possible to uniformize the height position of the fixing plate 13 by appropriately adjusting the heights of the projections 31 and/or 32. Note that the adjustment of the heights of the projections 31 and/or 32 can be performed by adjusting a metallic mold used for the injection molding with an adjusting member such as screw, etc. In such a manner, by adopting the configuration for allowing each of the plurality of projections 31 and 32 formed in the lower surface of the holder 14 to make contact with the fixing plate 13, it is possible to suppress the flatness of the fixing plate 13 to be small, as compared with a case of allowing the entire area of the lower surface of the holder 14 to make direct contact with the fixing late 13.

As depicted in FIG. 6B the lower surface of each of the second walls 22 is joined to the fixing plate 13 by the adhesive 24 in a state that the plurality of second projections 32 are pressed against and making contact with the upper surface of the fixing plate 13.

As explained above, in each of the head units 11 of the embodiment, the two first walls 21 of the holder 14 are arranged on the outer sides in the front/rear direction with respect to the six nozzle chips 12, respectively. The five first projections 31 are formed in each of the two first walls 21, and the first walls 21 are joined to the fixing plate 13 in the state that the five first projections 31 of each of the first walls 21 are making contact with the fixing plate 13. Owing to this configuration, it is possible to realize a highly precise flatness of the fixing plate 13 in each of the head units 11, and to suppress any variation (fluctuation) in the heights of the fixing plates 13 among the four head units 11, as well.

On the other hand, there are not any walls on the outer sides in the left/right direction with respect to the six nozzle chips 12, and the nozzle chips 12, among the six nozzle chips 12, located on the both end sides in the left/right direction are exposed from the holder 14. The phrase that the "nozzle chips 12 are exposed from the holder 14" means a situation wherein nozzle chips 12 on the both ends in the left/right directions are not covered by the holder 14. In this configuration, in a case that the four head units 11 are arranged side by side in the left/right direction, it is possible to arrange nozzle chips 12, of two adjacent heads units 11 among the four head units 11, closely to each other, thereby making it possible to shorten the distance between the nozzle chips 12 belonging respectively to the two adjacent head units 11.

A portion of each of the first walls 21 is allowed to interpose (enter) into the location between two adjacent nozzle chips 12 among the six nozzle chips 12. This configuration can be considered also as a configuration wherein the six recesses 21*a* corresponding to the six nozzle chips 12, respectively, are formed in a portion on the inner side in the front/rear direction with respect to the first walls 21. In this configuration, the nozzle chips 12 can be easily positioned with respect to the first walls 21 by inserting the respective nozzle chips 12 into the recesses 21*a*, respectively, during the assembly.

Further, each of the first projections 31 has a portion thereof which is arranged in the interposed portion 21*a*, of each of the first walls 21, arranged to be interposed into the location between the end portions of adjacent nozzle chips 12. With this, the distance between the first projections 31 and the nozzle chips 12 can be made small, thereby making it possible to determine the height position of the fixing plate 13 in the vicinity of the nozzle chips 12.

Furthermore, in the embodiment, each of the second walls 22 of the holder 14 are arranged between two adjacent nozzle chips 12, among the six nozzle chips 12, which are adjacent in the left/right direction. Each of the second walls 22 is formed with the plurality of second projections 32, and the plurality of second walls 22 are joined to the fixing plate 13 in the state that the plurality of second projections 32 are making contact with the fixing plate 13. Owing to this configuration, the height position of the fixing plate 13 can be determined assuredly also between the nozzle chips 12.

Note that since each of the second walls 22 is arranged between nozzle chips adjacent in the left/right direction, the spacing distance between the two adjacent nozzle chips 12 becomes great owing to the presence of the second wall 22. As the spacing distance is greater, the overlapping width W1 of the nozzles 15 between the two adjacent nozzle chips 12 becomes smaller, which in turn further makes it even difficult to allow the nozzles 15 to be continued to each other in the two adjacent nozzle chips 12. In view of this, in the present embodiment, all the six nozzle chips 12 of one head unit 11 are configured to jet the same kind of ink. In such a case, even if the two nozzle chips 12 are apart from each other to some extent in the left/right direction, it is not particularly difficult to allow the nozzles 15 configured to jet a same color ink to overlap with each other. Conversely, the configuration can be considered as a configuration wherein the second walls 22 can be easily arranged between the two adjacent nozzle chips 12.

Although it is allowable to form the first and second projections 31 to 32 to have a same size (dimension), the width of the second walls 22 cannot be made to be much great in view of securing the above-described overlapping width W1 to not less than a predetermined extent. Accordingly, there is a limit for increasing the size of the second projections 32, as well. On the other hand, there is no such a limitation regarding the first walls 21 positioned at the outer side in the front/rear direction with respect to the nozzle chips 12. Thus, in the present embodiment, the first projections 31 formed in the first walls 21 are formed to be greater than the second projections 32 formed in the second walls 22.

Further, in the embodiment, the second walls 22 each formed with the second projections 32 are arranged in all the five locations between the six nozzle chips 12. With this, it is possible to more assuredly suppress any variation in the height of the fixing plate 13 in the plane direction of the fixing plate 13.

With respect to the nozzle chips 12 on the central side, two pieces of the second wall 22 are arranged on the both sides in the left/right direction with respect to each of the nozzle chips 12 on the central side. In addition, each of the second projections 32 located on one side with respect to a certain nozzle chips 12, among the nozzle chips 12 on the central side, and one of the second projections 32 located on the other side with respect to the certain nozzle chip 12 are arranged to face each other in the chip short direction, with the certain nozzle chip 12 sandwiched therebetween. With this, the pressing manner by which the second projections 32 press the fixing plate 13 on the both sides in the chip short direction of the nozzle chips 12 becomes uniform, thereby making it possible to reduce the variation in height of the fixing plate 13 to be small.

In the embodiment as described above, the ink jet head 4 corresponds to the "liquid jetting apparatus" of the present teaching. The width direction of the recording paper corresponds to the "first direction" of the present teaching, and the conveying direction corresponds to the "second direction" of the present teaching. The chip longitudinal direction corresponds to the "predetermined direction" of the present teaching, and the chip short direction corresponds to the "direction orthogonal to the predetermined direction" of the present teaching.

Next, an explanation will be given about modifications in which various changes are made to the above-described embodiment. Note that, however, any parts or components constructed in the similar manner to that in the above-described embodiment are designated with same reference numerals, and description thereof is omitted as appropriate.

[Modification 1]

Figure 7:
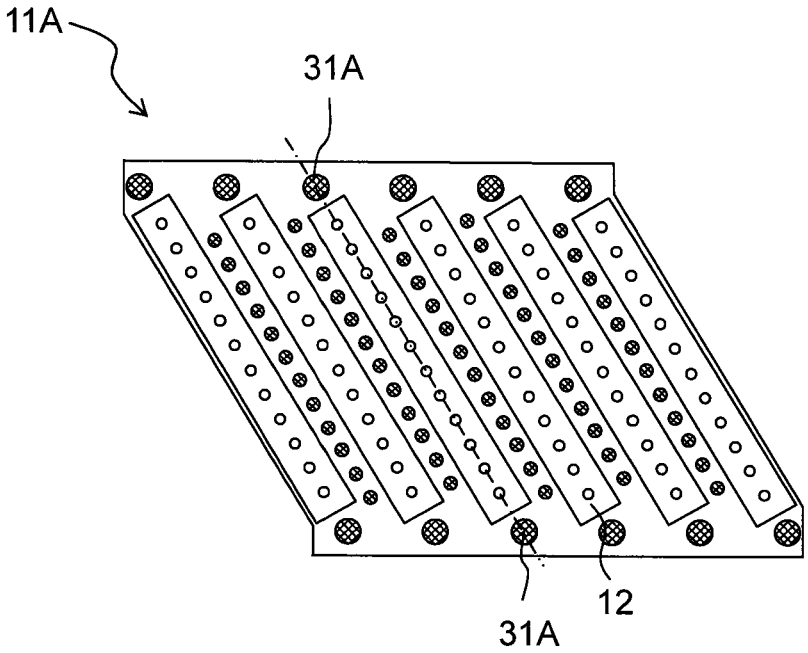
FIG. 7 is a bottom view of a head unit of a modification 1.

It is allowable that, as in a head unit 11A depicted in FIG. 7, two projections 31A are arranged to face each other in the chip longitudinal direction such that each of the nozzle chips 12 is sandwiched therebetween. With this, the pressing manner by which the first projections 31 press the fixing plate 13 becomes uniform on the both sides in the chip longitudinal direction, thereby making it possible to reduce the variation in height of the fixing plate 13 to be small. Further, as depicted in FIG. 7, in a case that the two first projections 31A are arranged on a straight line extending in the chip longitudinal direction and passing through the plurality of nozzles 15, it is possible to reduce the variation in height of the fixing plate 13 on the both sides in the chip longitudinal direction to be further small.

[Modification 2]

Figure 8:
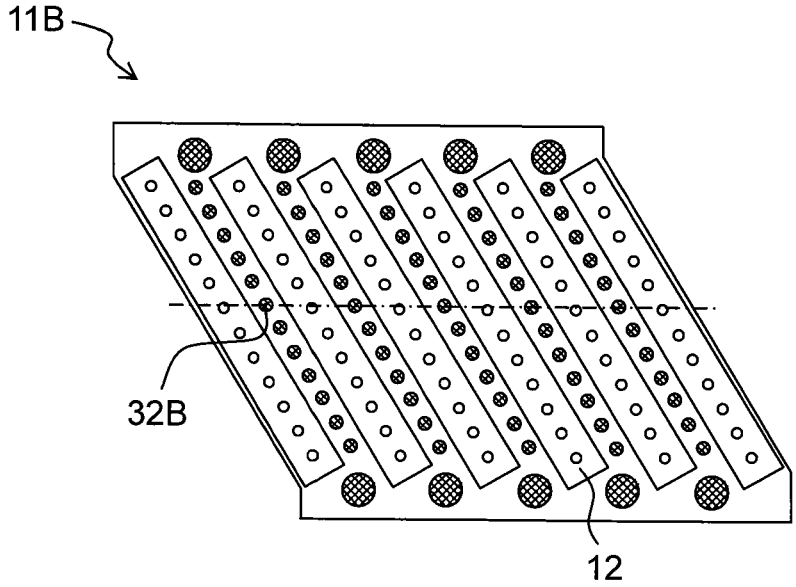
FIG. 8 is a bottom view of a head unit of a modification 2.

In the embodiment, two pieces of the second projection 32 arranged on the both sides of a nozzle chip 12 face each other in the chip short direction. It is allowable, however, that two pieces of second projections 32B on the both sides of each of the nozzle chips 12 face each other in the left/right direction, as in a head unit 11B depicted in FIG. 8. Namely, it is allowable that the positions of two second projections 32B, which are arranged on both the left and right sides of one piece of the nozzle chips 12, are coincident in the front/rear direction.

[Modification 3]

Figure 9:
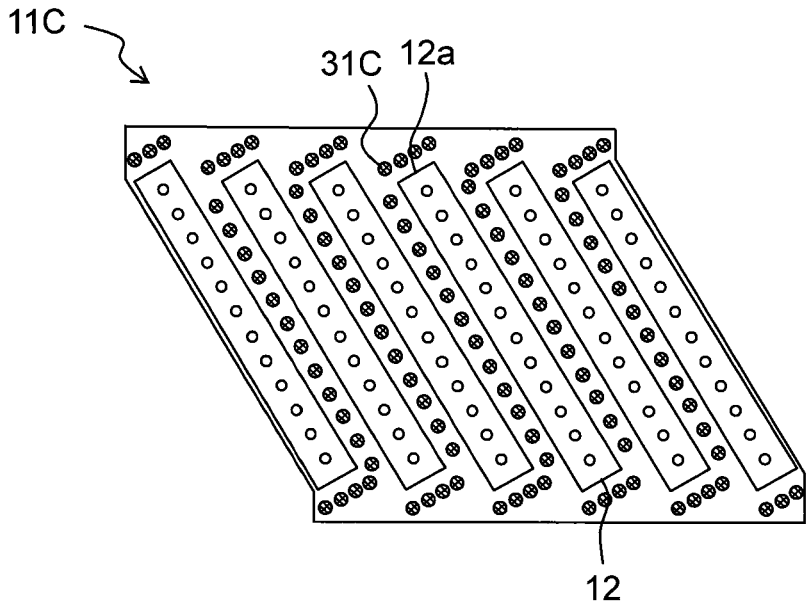
FIG. 9 is a bottom view of a head unit of a modification 3.

It is allowable that two or more pieces of a first projection 31C may be arranged along each of end surfaces 12*a* of the end portions in the longitudinal direction of each of the nozzle chips 12, as in a head unit 11C depicted in FIG. 9. In this configuration, it is possible to determine the height position of the fixing plate 13 assuredly in the vicinity of the end surfaces 12*a* of each of the nozzle chip 12.

[Modification 4]

In the embodiment, the second walls 22 are arranged in all of the five gaps between the six nozzle chips 12. In this configuration, however, the number of the second projection 32 becomes great. As the number of the second projection 32 increases, it takes more labor and effort for adjusting the heights of the second projections 32 so as to suppress the flatness of the fixing plate 13 to be small. In view of this, it is allowable that the second walls may be arranged only at a portion of the locations between the six nozzle chips 12. By omitting a portion of the second walls, such an effect is obtained that the overlapping amount of the nozzles 15 can be great at a location or locations at which the second wall is omitted.

Figure 10A:
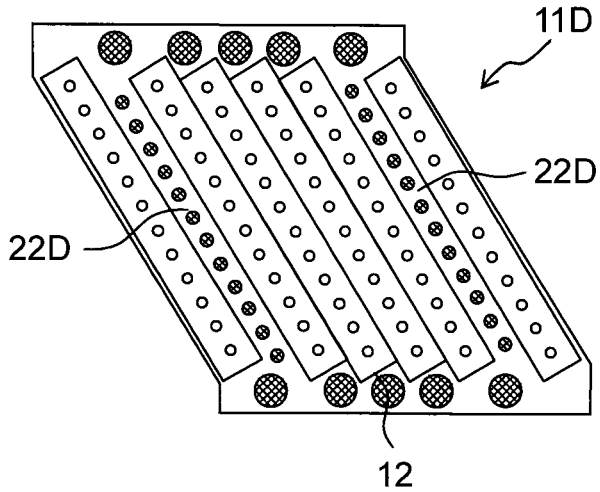
FIGS. 10A and 10B are each a bottom view of a head unit of a modification 4.
Figure 10B:
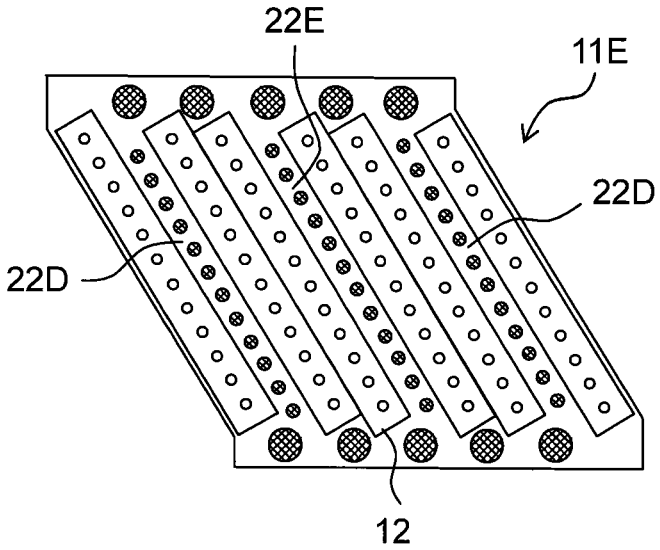

Note that no wall is present at the both sides in the left/right direction of the six nozzle chips 12, and there is also no projections for determining the height position of the fixing plate 13. In view of this, in a case of arranging the second walls only at a portion of the locations between the six nozzle chips 12, it is preferred that second walls 22D are arranged such that each of the second walls 22D is arranged between two adjacent nozzle chips 12, among the six nozzle chips 12, which are arranged closer to one end side or the other end side in the left/right direction, as in a head unit 11D depicted in FIG. 10A. In a case of arranging more pieces of the second wall, it is preferred that second walls 22E are arranged also between two nozzle chips 12, among the six nozzle chips 12, which are arranged on the central side in the left/right direction, in addition to the above-described two second walls 22D each arranged closer to one end side or the other end side in the left/right direction, as in a head unit 11E depicted in FIG. 10B. With such a configuration, it is possible to determine the height position of the fixing plate 13 assuredly also at the central portion thereof which is distanced from the both end portions in the left/right direction.

[Modification 5]

Figure 11:
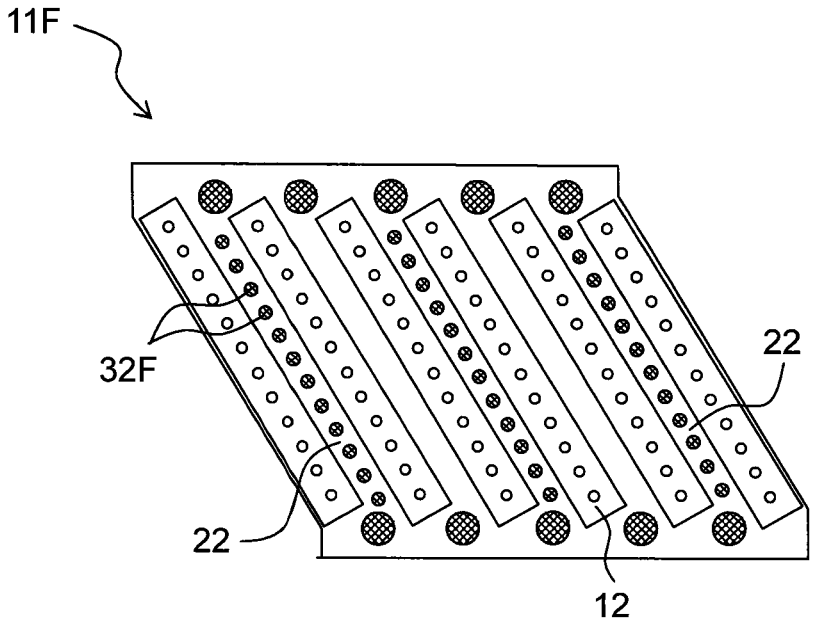
FIG. 11 is a bottom view of a head unit of a modification 5.

It is not necessarily indispensable that the second projections are formed at all of the second walls each of which is located between adjacent nozzle chips among the six nozzle chips. Namely, in a head unit 11F depicted in FIG. 11, second projections 32F are provided only on three second walls 22F, in total, which are included in five second walls 22F present between the six nozzle chips 12, and which are located at the both end sides and the central side in the left/right direction. In this configuration, since the number of the second projection 31F is smaller as compared with the configuration of the embodiment (see FIG. 5), it is possible to reduce the labor and effort for performing the adjustment for the second projections 31F.

[Modification 6]

It is not necessarily indispensable that the size (dimension) and/or the density of arrangement of the second projections are same among the plurality of second walls arranged side by side in the width direction of the recording paper. As described above, at the both sides in the left/right direction of the six nozzle chip 12, there are no walls and there are also no projections for determining the height position of the fixing plate. In this situation, in view of suppressing the variation in the height of the fixing plate at the end sides in the left/right direction, it is preferred that the second projections formed on the second walls, which are located at the endmost sides in the left/right direction are allowed to substitute for projections which might be originally provided on the wall portions that might be originally located at the outer sides of the six nozzle chips with respect to the left/right direction.

Figure 12A:
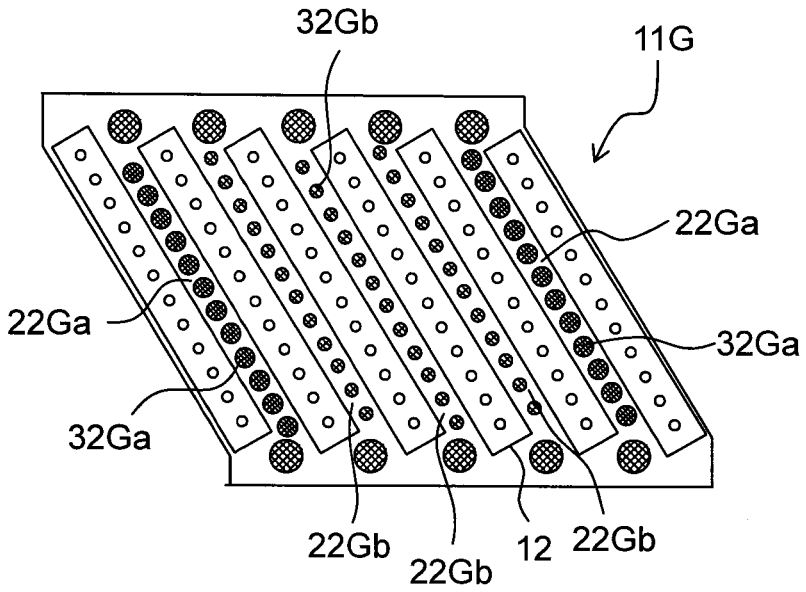
FIGS. 12A and 12B are each a bottom view of a head unit of a modification 6.
Figure 12B:
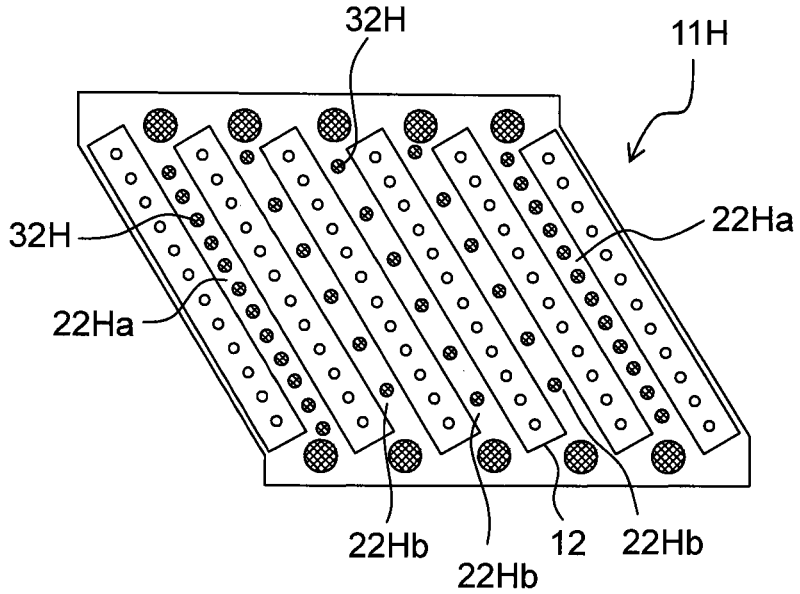

From the above viewpoint, it is preferred that in each of the second walls arranged on one end side or the other end side in the left/right direction, the size of the second projections and/or the arrangement density of the second projections are/is greater than those of the second projections of the second walls arranged on the central side. For example, in a head unit 11G depicted in FIG. 12A, second projections 32Ga formed in two second walls 22Ga arranged on the both end sides in the left/right direction are greater than second projection 32Gb formed in three second walls 22Gb located on the central side in the left/right direction. Alternatively, in a head unit 11H depicted in FIG. 12B, each of two second walls 22Ha located respectively on the both end sides in the left/right direction has such a configuration wherein the arrangement pitch of second projections 32H is smaller and the arrangement density of the second projections 32H is higher than the arrangement pitch and the arrangement density of the second projections 32H of three second walls 22Hb arranged on the central side. In the configuration depicted in FIG. 12B, in a case that the arrangement pitch of the second projections 32H is too narrow, the number of the second projections 32H becomes too great, which in turn requires more labor and effort for the adjustment. Further, in a case that the arrangement pitch of the second projections 32H is too great, it is not possible to suppress the flatness of the fixing plate 13 to be small. An example of the appropriate arrangement pitch of the second projections 32H includes, for example, 2.35 mm for those arranged on the second walls 22Ha on the both end sides in the left/right direction, and 5.5 mm for those arranged on the second walls 22Hb on the central side.

[Modification 7]

It is not necessarily indispensable that the second projections are arranged evenly (uniformly) in the chip longitudinal direction. For example, since the first projections are arranged in the vicinity of the end portions of the second walls, it is allowable that the second projections are arranged in a concentrated manner at a central portion of each of the second walls. Specifically, in a head unit 11I depicted in FIG. 13A, second projections 32I are arranged only at a central portion of each of the second walls 22.

Figure 13A:
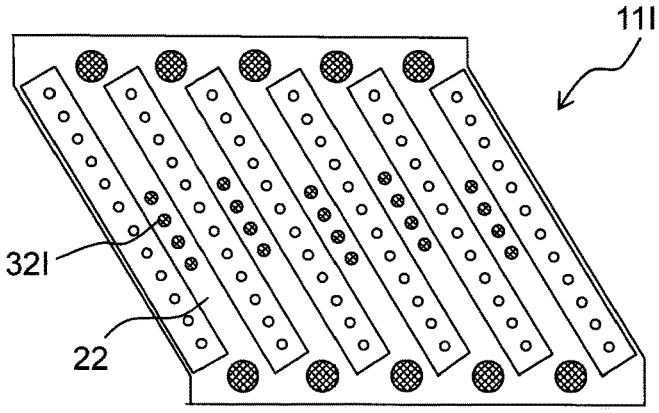
FIGS. 13A to 13C are each a bottom view of a head unit of a modification 7.
Figure 13B:
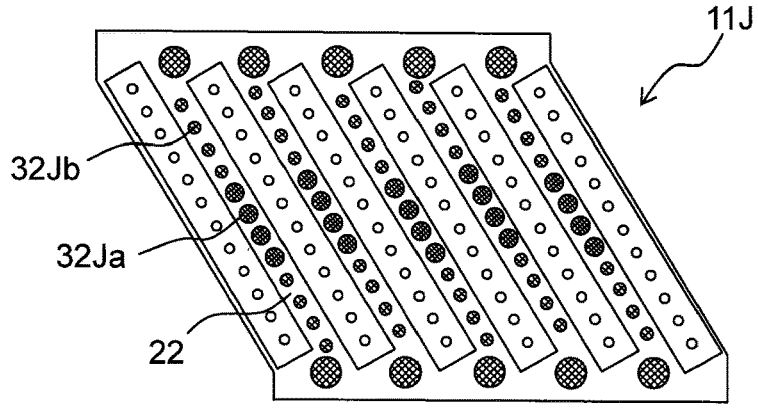

Alternatively, in a head unit 11J depicted in FIG. 13B, the size of second projections 32Ja arranged on a central portion of each of the second walls 22 is greater than the size of second projections 32Jb arranged on end sides of each of the second walls 22. Note that in the configuration depicted in FIG. 13B, in a case that the width of the second walls 22 is made to be too large, the overlapping width between the nozzle chips 12 becomes small. On the other hand, in a case that the width of the second walls 22 is made to be too small, it is only possible to form second projections having a small size. In view of these situations, the appropriate range of the width of the second walls 22 is in a range of 0.5 mm to 0.6 mm. In this case, the diameter of the second projections 32Jb on the end sides is preferably made to be 0.3 mm, and the diameter of the second projections 32Ja on the central side is preferably made to 0.45 mm that is 1.5 times the diameter of the second projections 32Jb on the end sides.

Figure 13C:
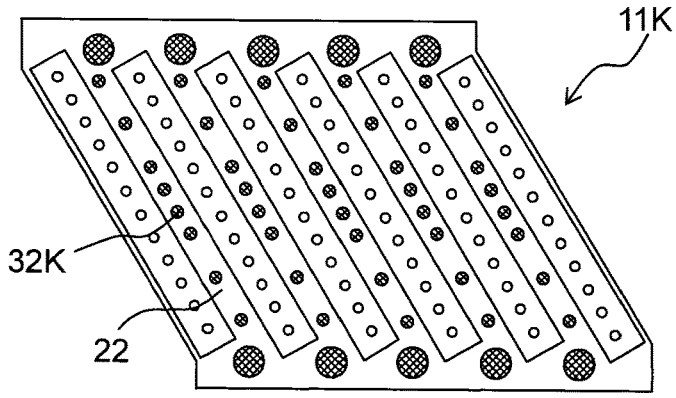

Alternatively, in a head unit 11K depicted in FIG. 13C, the arrangement pitch of second projections 32K is smaller and the arrangement density of the second projections 32K is higher in the central portion of each of the second walls 22 than in those in the end portions thereof.

In the configurations depicted in FIGS. 13A to 13C, respectively, it is possible to suppress the flatness of the fixing plate 13 to be small at the central portion thereof distanced from the first projections, by making the number of the second projections to be great at the central portion of each of the second walls, or by making the size of the second projections to be large at the central portion of each of the second walls. Further, in particular, in the configurations depicted in FIGS. 13A and 13C, it is possible to reduce the labor and effort required for the adjustment by making the number of the second projections to be small at a location close or near to the first projection.

[Modification 8]

Figure 14:
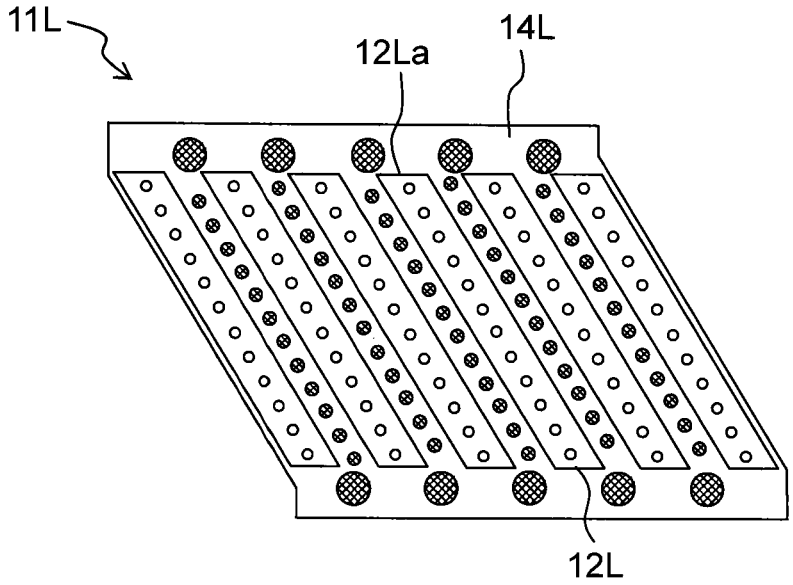
FIG. 14 is a bottom view of a head unit of a modification 8.

It is allowable that an end surface 12La of end surfaces 12La of end portions in the chip longitudinal direction of each of nozzle chips 12L may be a surface along the left/right direction, as in a head unit 11L depicted in FIG. 14. In a case that the end surface 12La of the nozzle chip 22L is along the left/right direction, an end portion of the nozzle chip 12L is made to abut against a same inner wall surface of a holder 14L, and thus the positions of the nozzle chips 12L in the conveyance direction can be easily aligned.

[Modification 9]

Figure 15:
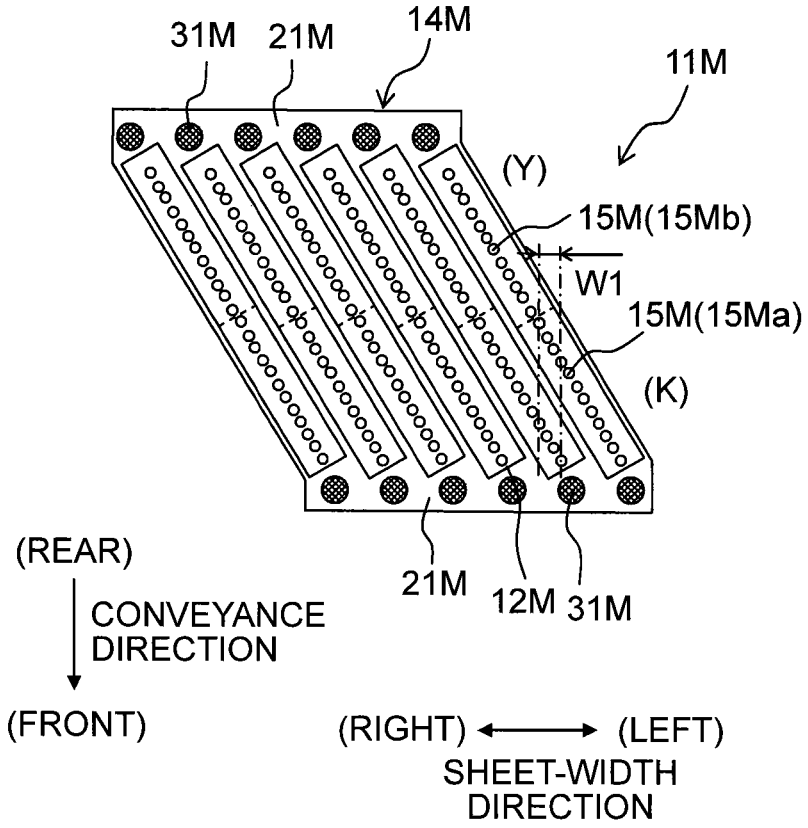
FIG. 15 is a bottom view of a head unit of a modification 9.

It is also possible to adopt such a configuration that no walls are provided between nozzle chips 12M, as in a head unit 11M depicted in FIG. 15. In the configuration of FIG. 15, two first walls 21M of a holder 14M are arranged at the outer sides, respectively, in the front/rear direction with respect to six nozzle chips 12M. The lower surface of each of the first walls 21M is formed with six first projections 31M. In this configuration also, it is possible to realize a highly precise flatness for the fixing plate by joining the first walls 21M to the fixing plate in a state that the first projections 31M are making contact with the fixing plate.

Note that the configuration of FIG. 15 is suitable for a case that one piece of the nozzle chips 12M jets two or more kinds of the ink. For example, in the configuration of FIG. 15, nozzles 15Ma, which are included in a plurality of nozzles 15M constructing each of the nozzle chips 12M and which are located on the front side, are nozzles configured to jet a black ink; and nozzles 15Mb located on the rear side are nozzles configured to jet a yellow ink. In this case, the length of a nozzle row jetting one color ink is half, and thus unless the distance between two pieces of the nozzle chip 12M is considerably short, it is not possible, in two pieces of the nozzle chip 12M, to make nozzles jetting the same color ink to be continuous and/or to overlap the nozzles jetting the same color ink. Accordingly, in a case of using the nozzle chips 12M configured to jet two or more color inks as depicted in FIG. 15, it is preferred to adopt a configuration wherein no walls are present between two pieces of the nozzle chip 12M and that two pieces of the nozzle chip 12M are arranged side by side in the left/right direction without any walls intervened therebetween.

As described above, the length of the nozzle row jetting one color ink is half in the configuration of Modification 9 as compared with the configuration of the embodiment (see FIG. 5). Accordingly, the overlapping width W1 between two adjacent nozzle chips 12M becomes small, and thus it is difficult to make the number of the overlapping nozzles 15 to be equal (equivalent) to that in the configuration of the embodiment (see FIG. 5). Even under this situation, however, it is desired that the number of the nozzle 15M jetting a same color ink and overlapping between the two adjacent nozzle chips 12 M is secured to some extent (for example, 40 pieces), for the purpose of making the joint between two adjacent nozzle chips 12 be less conspicuous.

Regarding this task, in FIG. 15, the overlapping width W1 (=2.111 mm) and the total number (200 pieces) of the nozzles 15 in each nozzle row jetting one of the respective color inks are made to be half of those in the above-described embodiment. On the other hand, the arrangement pitch (84.7 μm) of the nozzles 15M in the chip longitudinal direction and the inclination angle (60 degrees) of the nozzle chip 12M with respect to the left/right direction are made to be same as those in the above-described embodiment. In such a case, the number of the nozzles 15M which are configured to jet a same color ink and which are overlapped with each other between two adjacent nozzle chips 12M is approximately 50 pieces, namely, ¼ of the nozzles jetting the same color ink in each of the head chips 12M overlap with each other.

Note that in the nozzle chip 12M of FIG. 15, the black nozzles 15Ma located on the front side correspond to the "first nozzles" of the present teaching, and the yellow nozzles 15Mb located on the rear side correspond to the "second nozzles" of the present teaching.

Figure 16:
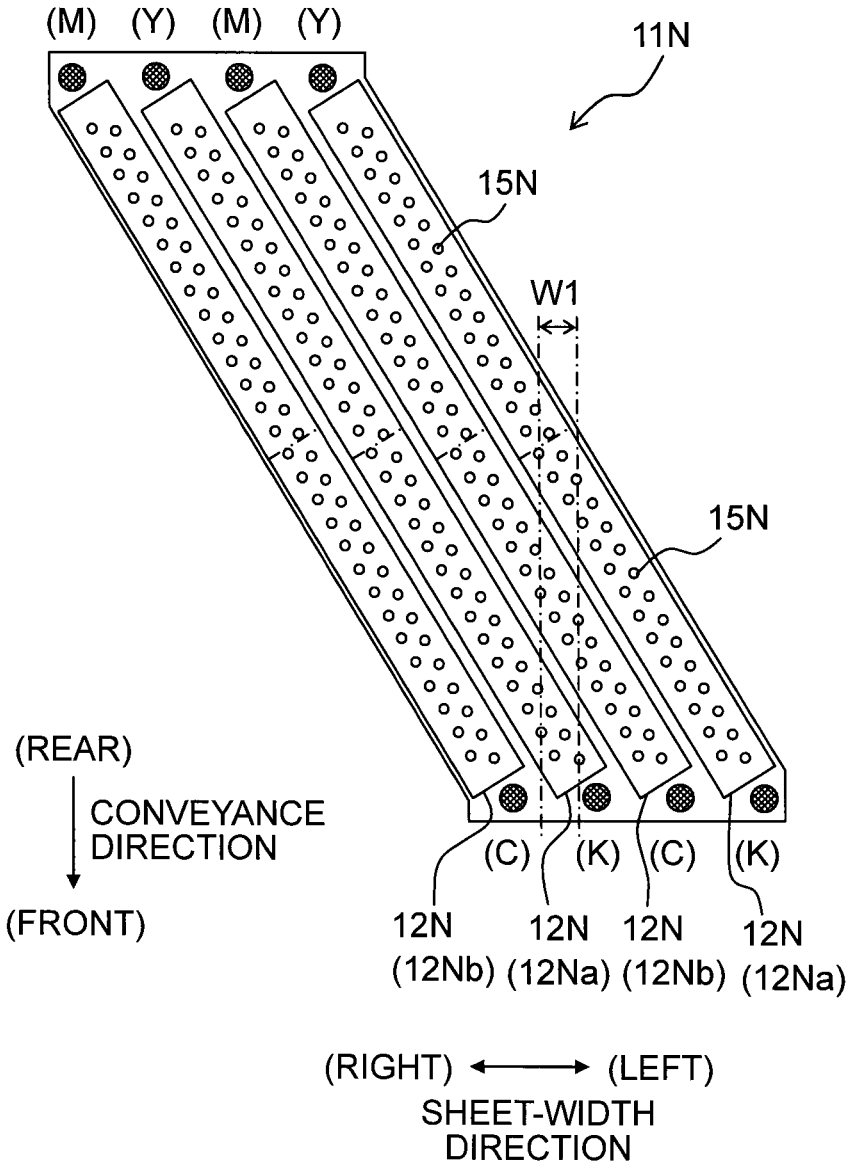
FIG. 16 is a bottom view of a modification of the head unit depicted in FIG. 15.
Figure 17:
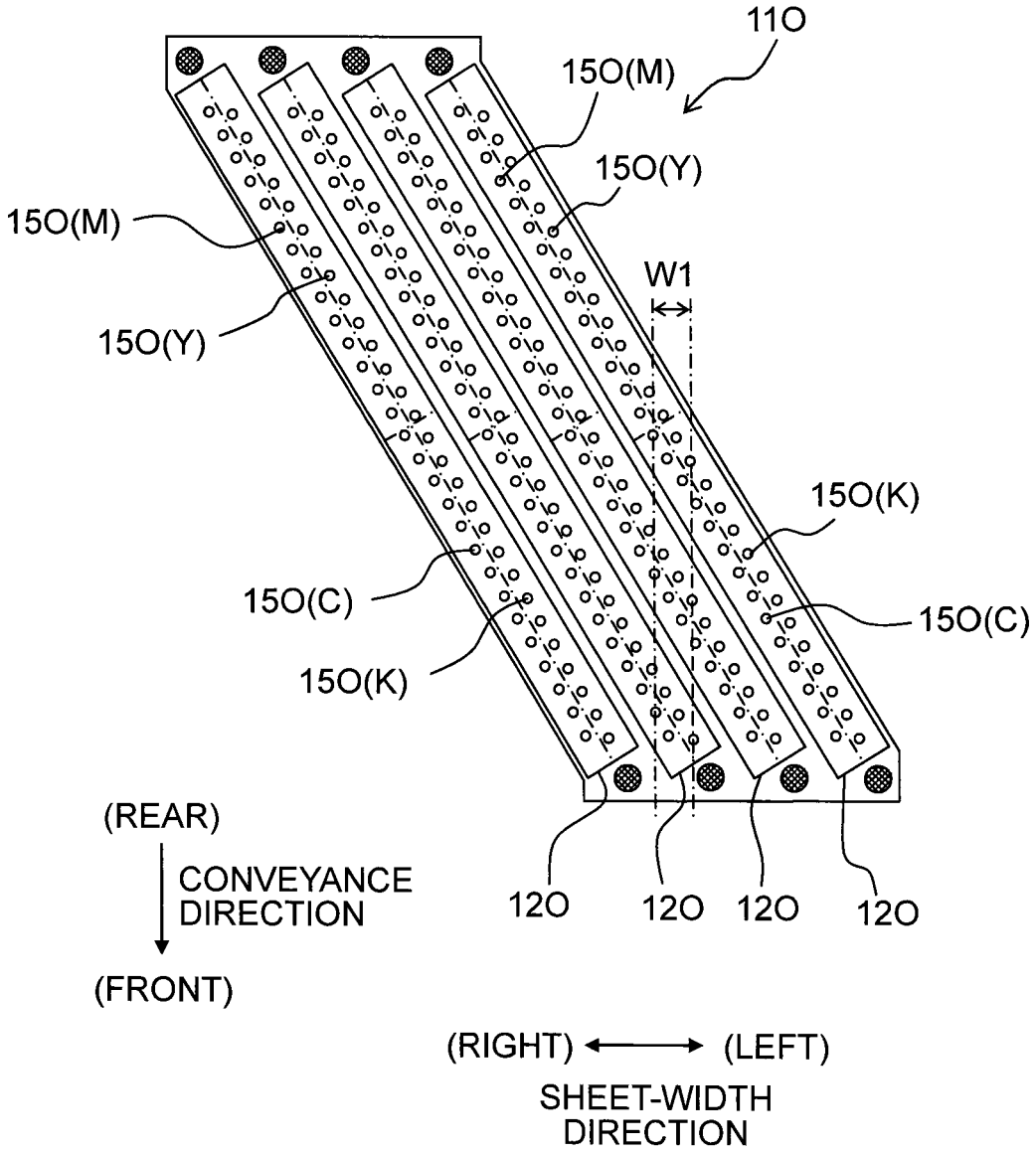
FIG. 17 is a bottom view of another modification of the head unit depicted in FIG. 5.

Further, as a modification of the configuration of FIG. 15, it is allowable that, as in a head unit 11N of FIG. 16, one piece of nozzle chip 12N is configured to have two nozzle rows. The configuration of FIG. 16 is similar to that in FIG. 15 in that the kinds of the ink jetted are different on one side and the other side in the chip longitudinal direction of two nozzle rows. Note that, however, in the configuration of FIG. 16, two nozzle chips 12Na configured to jet black and yellow inks and two nozzle chips 12Nb configured to jet cyan and magenta inks are arranged alternately in the width direction of the recording paper. Namely, between the two nozzle chips 12Na, one of another nozzle chips 12Nb jetting the inks different from those jetted from the two nozzle chips 12Na is arranged. In this configuration, since four color inks can be jetted from one head unit, it is possible to construct a color ink jet printer of which size in the conveyance direction is smaller as compared with a configuration wherein four color ink jet heads are arranged side by side in the conveyance direction. Further, as a modification of FIG. 16, it is allowable that as in a head unit 11O depicted in FIG. 17, the colors of the inks jetted from two nozzle rows which are included in one nozzle chip 12O may be different. Specifically, in a nozzle row which is included in a certain nozzle chip 12O and which is located on the left side, nozzles 15O on the front side jet a cyan ink, and nozzles 15O on the rear side jet a magenta ink. On the other hand, in a nozzle row which is included in the certain nozzle chip 12O and which is located on the right side, nozzles 15O on the front side jet a black ink and nozzles 15O on the rear side jet a yellow ink. Namely, the four color inks may be jetted from one nozzle chip 12O.

[Modification 10]

Figure 18:
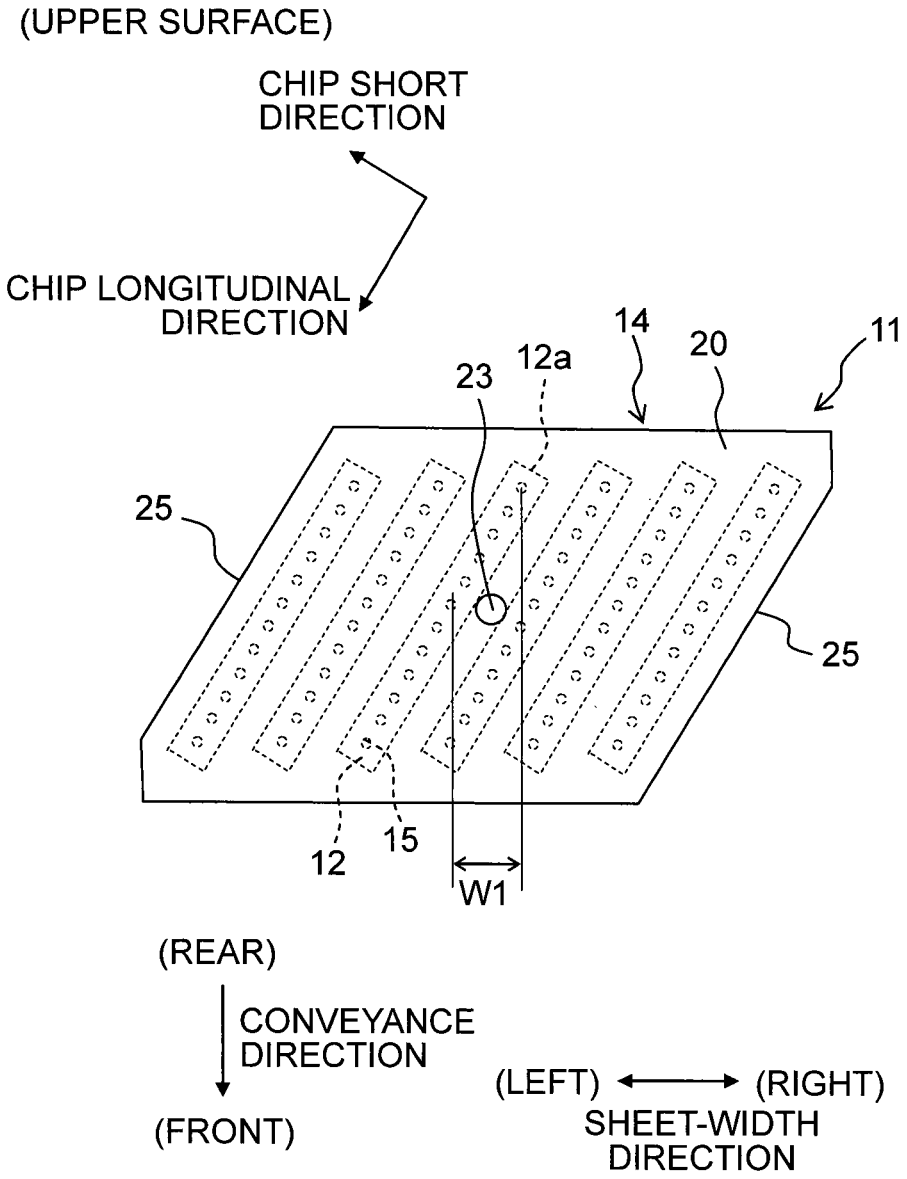
FIG. 18 is a top view of a head unit of a modification 10.

In the embodiment, the holder 14 of each of the head units 11 has the two first walls 21 extending downwardly from both end portions in the front/rear directions of the ceiling portion 20, and the five second walls 22 extending downwardly from the ceiling portion 20. However, there is no limitation to this. For example, as depicted in FIG. 18, the folder 14 may further have two third walls 25 extending downwardly from both the left and right end portions of the ceiling portion 20. In such a case, the flatness of the fixing plate 13 can be further enhanced.

[Modification 11]

Figure 19:
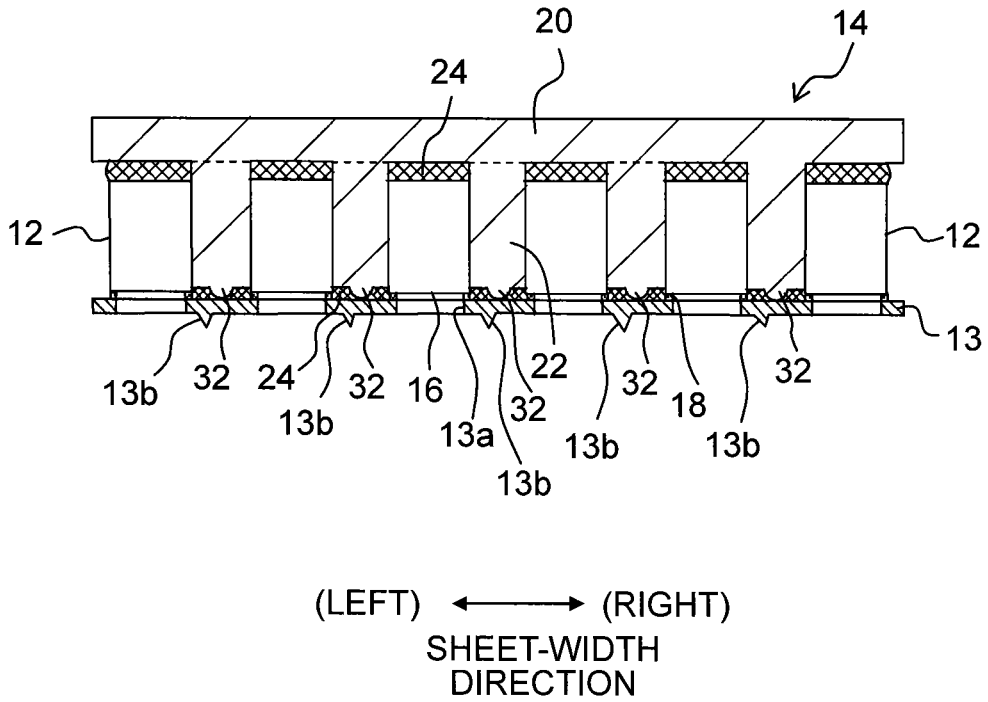
FIG. 19 is a cross-sectional view of a modification 11, corresponding to FIG. 6B.

In the embodiment, any projection is not provided on the lower surface of the fixing plate 13. However, there is no limitation to this. For example, as depicted in FIG. 19, the lower surface of the fixing plate 13 may be provided with ribs 13*b* projecting downwardly and extending in the chip longitudinal direction so as to prevent the recording paper 100 from contacting the jetting surface 16. In such a case, it is preferred that the ribs 13*b* projecting from the lower surface of the fixing plate 13 and the second projections 32 of each of the second walls 22, which are fixed on the upper surface of the fixing plate 13, are not overlapped with one another in the up/down direction, namely are shifted in the left/right direction relative to one another, so as to maintain the flatness of the fixing plate 13.

[Modification 12]

In the above-described embodiment, the holder and the fixing plate are provided individually (separately) on each of the head units. Namely, the holder and the fixing plate are configured to be separated among the plurality of head units. On the other hand, it is allowable to provide such a configuration that the holder and the fixing plate are each linked to each other among the plurality of head units so as to be integrally formed.

[Modification 13]

In FIGS. 4 and 5 of the above-described embodiment, the edge portions of the holder 14 in the conveyance direction are parallel to the left/right direction. It is allowable, however, that the edge portions are formed to have a zig-zag shape in accordance with the shape of the end surfaces of the respective nozzle chips 12.

[Modification 14]

In FIG. 5 of the above-described embodiment, the both end portions of each of the second walls 22 extending in the chip longitudinal direction are continuously connected to the first walls 21. It is allowable, however, that the second walls are not connected to the first walls. It is sufficient, for example, that the second walls 22 are provided on locations such as those in the vicinity of an end portion of the nozzle chip 12 and/or the central portion of the nozzle chip 12 at which the second projections 32 are desired to be arranged, and other than that, it is allowable that the second wall 22 are not present.

In the embodiment and the modifications thereof as described above, the present teaching is applied to the ink jet head configured to jet an ink(s) onto a recording paper to thereby record an image, etc. on the recording paper. However, the present teaching is applicable also to liquid jetting apparatuses usable for various kinds of applications other than the printing of image, etc. For example, the present teaching is applicable also to a liquid jetting apparatus which forms a conductive pattern on a surface of a substrate by jetting a conductive liquid onto the substrate.

What is claimed is:

1. A head unit comprising:

nozzle chips which are arranged side by side in a first direction, each of the nozzle chips having a jetting surface and nozzles aligned in a predetermined direction parallel to the jetting surface and crossing both of the first direction and a second direction orthogonal to the first direction;

a holder configured to hold the nozzle chips from a side opposite to the jetting surface of each of the nozzle chips; and a fixing plate to which the nozzle chips are fixed and which is arranged on a side facing the jetting surface of each of the nozzle chips, wherein the holder has first walls arranged in the second direction so as to sandwich the nozzle chips therebetween, each of the first walls has first projections formed on a lower surface thereof facing the fixing plate, and the first projections make contact with the fixing plate and wherein two nozzle chips included in the nozzle chips are exposed from the holder in the first direction.

2. The head unit according to claim 1, wherein end surfaces of end portions, of each of the nozzle chips, in the predetermined direction cross the first direction, and a portion of each of the first walls is arranged to be interposed between the end portions of two adjacent nozzle chips, among the nozzle chips, which are adjacent in the first direction.

3. The head unit according to claim 2, wherein the first projections are provided as two or more first projections which are arranged along the end surfaces of the end portions, of each of the nozzle chips, in the predetermined direction.

4. The head unit according to claim 1, wherein the first projections arranged on one side in the second direction with respect to the nozzle chips and the first projections arranged on the other side in the second direction with respect to the nozzle chips are arranged to face one another in the predetermined direction with the nozzle chips sandwiched therebetween.

5. The head unit according to claim 1, wherein the nozzles of each of the nozzle chips include first nozzles arranged on one side in the predetermined direction and second nozzles arranged on the other side in the predetermined direction, the first nozzles and the second nozzles being configured to jet different kinds of liquids, respectively, and no wall of the holder is arranged between two nozzle chips, among the nozzle chips, which are adjacent in the first direction.

6. The head unit according to claim 1, wherein the nozzle chips include a first nozzle chip and a second nozzle chip which are adjacent in the first direction, and a part of the nozzles belonging to the first nozzle chip and a part of the nozzles belonging to the second nozzle chip are overlapped with each other in the second direction.

7. The head unit according to claim 1, wherein the holder further includes third walls which are arranged on outer sides in the first direction with respect to the nozzle chips.

8. A head unit comprising:

nozzle chips which are arranged side by side in a first direction, each of the nozzle chips having a jetting surface and nozzles aligned in a predetermined direction parallel to the jetting surface and crossing both of the first direction and a second direction orthogonal to the first direction;

a holder configured to hold the nozzle chips from a side opposite to the jetting surface of each of the nozzle chips; and a fixing plate to which the nozzle chips are fixed and which is arranged on a side facing the jetting surface of each of the nozzle chips, wherein the holder has first walls arranged in the second direction so as to sandwich the nozzle chips therebetween, each of the first walls has first projections formed on a lower surface thereof facing the fixing plate, and the first projections make contact with the fixing plate, wherein two nozzle chips included in the nozzle chips are exposed from the holder in the first direction, wherein end surfaces of end portions, of each of the nozzle chips, in the predetermined direction cross the first direction, and a portion of each of the first walls is arranged to be interposed between the end portions of two adjacent nozzle chips, among the nozzle chips, which are adjacent in the first direction, and wherein at least a portion of each of the first projections is arranged in the portion, of one of the first walls, which is interposed between the two adjacent nozzle chips.

9. The head unit according to claim 8, wherein the end surfaces of the end portions, of each of the nozzle chips, in the predetermined direction are parallel to a direction orthogonal to the predetermined direction.

10. A head unit comprising:

nozzle chips which are arranged side by side in a first direction, each of the nozzle chips having a jetting surface and nozzles aligned in a predetermined direction parallel to the jetting surface and crossing both of the first direction and a second direction orthogonal to the first direction;

a holder configured to hold the nozzle chips from a side opposite to the jetting surface of each of the nozzle chips; and a fixing plate to which the nozzle chips are fixed and which is arranged on a side facing the jetting surface of each of the nozzle chips, wherein the holder has first walls arranged in the second direction so as to sandwich the nozzle chips therebetween, each of the first walls has first projections formed on a lower surface thereof facing the fixing plate, and the first projections make contact with the fixing plate, wherein two nozzle chips included in the nozzle chips are exposed from the holder in the first direction, wherein the holder has a second wall which extends in the predetermined direction and which is arranged between two adjacent nozzle chips, among the nozzle chips, which are adjacent in the first direction, and an end surface, of the second wall, on a side facing the fixing plate, is formed with second projections which make contact with the fixing plate.

11. The head unit according to claim 10, wherein a size of each of the first projections is greater than a size of each of the second projections.

12. The head unit according to claim 10, wherein the nozzle chips are provided as at least four nozzle chips, the second wall is provided as second walls, and the second walls include two second walls each of which is arranged between the two adjacent nozzle chips, which are located closer to one end side or the other end side in the first direction.

13. The head unit according to claim 12, wherein the second walls also include a second wall arranged between the two adjacent nozzle chips which is located on a central side in the first direction.

14. The head unit according to claim 13, wherein in each of the second walls arranged between the two adjacent nozzle chips located closer to the one end side or the other end side, the size of each of the second projections is greater than the size of each of the second projections in the second wall arranged between the two adjacent nozzle chips located on the central side.

15. The head unit according to claim 13, wherein in each of the second walls arranged between the two adjacent nozzle chips located closer to the one end side or the other end side, arrangement pitch of the second projections in the predetermined direction is smaller than arrangement pitch of the second projections in the predetermined direction in the second wall arranged between the two adjacent nozzle chips arranged on the central side.

16. The head unit according to claim 10, wherein the second wall is provided as second walls which are arranged at all locations between the nozzle chips.

17. The head unit according to claim 10, wherein the second wall is provided as second walls arranged only at a portion of locations between the nozzle chips.

18. The head unit according to claim 10, wherein the second projections are formed at least in a central portion, of the second wall, in the predetermined direction.

19. The head unit according to claim 10, wherein the second wall is provided as two second walls arranged respectively at both sides, of one of the nozzle chips, in the first direction, and the second projections of one of the two second walls and the second projections of the other of the two second walls are arranged to face one another in a direction parallel to the jetting surface and orthogonal to the predetermined direction, with the one of the nozzle chips sandwiched therebetween.

20. The head unit according to claim 10, wherein the nozzle chips jet a same kind of liquid from the nozzles.

21. A liquid jetting apparatus comprising head units arranged side by side in a first direction, each of the head units including:

nozzle chips which are arranged side by side in the first direction, each of the nozzle chips having a jetting surface and nozzles aligned in a predetermined direction parallel to the jetting surface and crossing both of the first direction and a second direction orthogonal to the first direction;

a holder configured to hold the nozzle chips from a side opposite to the jetting surface of each of the nozzle chips; and a fixing plate to which the nozzle chips are fixed and which is arranged on a side facing the jetting surface of each of the nozzle chips, wherein the holder has first walls arranged in the second direction so as to sandwich the nozzle chips therebetween;

two nozzle chips included in the nozzle chips are exposed from the holder in the first direction;

each of the first walls has first projections formed on a lower surface thereof facing the fixing plate; and the first projections make contact with the fixing plate and wherein two nozzle chips included in the nozzle chips are exposed from the holder in the first direction.

* * * * *